US006688541B2

(12) United States Patent
Boecking

(10) Patent No.: US 6,688,541 B2
(45) Date of Patent: Feb. 10, 2004

(54) FUEL INJECTION SYSTEM FOR AN INTERNAL COMBUSTION ENGINE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/314,346

(22) Filed: Dec. 9, 2002

(65) Prior Publication Data

US 2003/0106948 A1 Jun. 12, 2003

(30) Foreign Application Priority Data

Dec. 7, 2001 (DE) ..... 101 60 258

(51) Int. Cl.[7] ..... F02M 51/00

(52) U.S. Cl. ..... 239/585.1; 239/88; 239/89; 239/585.2; 239/585.3; 239/585.4; 239/585.5; 239/93

(58) Field of Search ..... 239/585.1, 585.2, 239/585.3, 585.4, 585.5, 583, 584, 88, 89, 90, 92, 94, 95, 96, 93

(56) References Cited

U.S. PATENT DOCUMENTS 5,056,488 A * 10/1991 Eckert ..... 123/446
6,078,235 A * 6/2000 Schebitz et al. ..... 239/585.1
6,209,805 B1 * 4/2001 Male et al. ..... 239/585.1
6,622,936 B2 * 9/2003 Boecking ..... 239/89
6,644,281 B2 * 11/2003 Boehland ..... 239/88
2003/0019960 A1 * 1/2003 Magel ..... 239/585.5
2003/0111051 A1 * 6/2003 Boehland ..... 239/88

* cited by examiner

*Primary Examiner*—Robin O. Evans
(74) *Attorney, Agent, or Firm*—Ronald E. Greigg

(57) ABSTRACT

For each cylinder of the internal combustion engine, the fuel injection system has one high-pressure fuel pump and one fuel injection valve communicating with it. A first pump piston of the high-pressure fuel pump defines a pump work chamber, which communicates with a pressure chamber of the fuel injection valve; the fuel injection valve has an injection valve member, by which injection openings are controlled, and which is movable by the pressure prevailing in the pressure chamber in an opening direction counter to a closing force. The high-pressure fuel pump has a second pump piston, which defines a work chamber, and on which, after an initial pumping stroke, the first pump piston comes to rest, so that the second pump piston likewise executes a pumping stroke. By means of a first control valve, a communication of the pump work chamber with a relief chamber is controlled, and by a second control valve, a communication of a control pressure chamber, which is in communication with the work chamber and is defined by a control piston acting at least indirectly on the injection valve member in the closing direction, with a relief chamber is controlled.

17 Claims, 2 Drawing Sheets

10
20
14
19
316
218
216
60
118
64
116
16
18
22
II
74
68
65
66
63
69
49
48
50
46
76
70
71
54
56
67
52
81
80
82
87
84
86
78
24
a
51
44
28
30
29
42
40
38
34
32
36
12

FUEL INJECTION SYSTEM FOR AN INTERNAL COMBUSTION ENGINE

BACKGROUND OF THE INVENTION

1. Field of the Invention

The invention is directed to an improved fuel injection system for an internal combustion engine.

2. Description of the Prior Art

One fuel injection system of the type with which this invention is concerned is known from European Patent Disclosure EP 0 987 431 A2. This fuel injection system has one high-pressure fuel pump, and one fuel injection valve communicating with it, for each cylinder of the engine. The high-pressure fuel pump has a pump piston, which is driven in a reciprocating motion by the engine and which defines a pump work chamber. The fuel injection valve has a pressure chamber communicating with the pump work chamber and also has an injection valve member, by which at least one injection opening is controlled, and which is movable, being acted upon by the pressure prevailing in the pressure chamber, in the opening direction counter to a closing force in order to open the at least one injection opening. A first electrically actuated control valve is provided, by which a communication of the pump work chamber with a relief chamber is controlled. By means of a control piston, a control pressure chamber is defined, and the control piston, acted upon by the pressure prevailing in the control pressure chamber, acts on the injection valve member in the closing direction. The control pressure chamber has a communication, controlled by a second electrically actuated control valve, with a relief chamber. For a fuel injection, the first control valve is closed and the second control valve is opened, so that high pressure cannot build up in the control pressure chamber, and the fuel injection valve can open. With the second control valve open, however, fuel flows out of the pump work chamber via the control pressure chamber, so that the fuel quantity available for the injection, from the fuel quantity pumped by the pump piston, and the pressure available for the injection is reduced as well.

OBJECT AND SUMMARY OF THE INVENTION

The fuel injection system of the invention has the advantage over the prior art that because of the communication of the control pressure chamber with the work chamber defined by the second pump piston, when the second control valve is open for the fuel injection and the fuel injection valve is thus also open, no fuel flows out via the pump work chamber, and thus all the fuel pumped by the first pump piston, and the pressure generated by the first pump piston in the pump work chamber, are available, undiminished, for the fuel injection.

Other advantageous features and refinements of the fuel injection system of the invention are disclosed. For example, one embodiment makes a space-saving disposition of the second pump piston possible. Another embodiment in a simple way makes slaving of the second pump piston after the initial stroke of the first pump piston possible.

BRIEF DESCRIPTION OF THE DRAWINGS

The invention will be better understood and further objects and advantages thereof will become more apparent from the ensuing detailed description, taken in conjunction with the drawings, in which.

DESCRIPTION OF THE PREFERRED EMBODIMENTS

Figure 1:
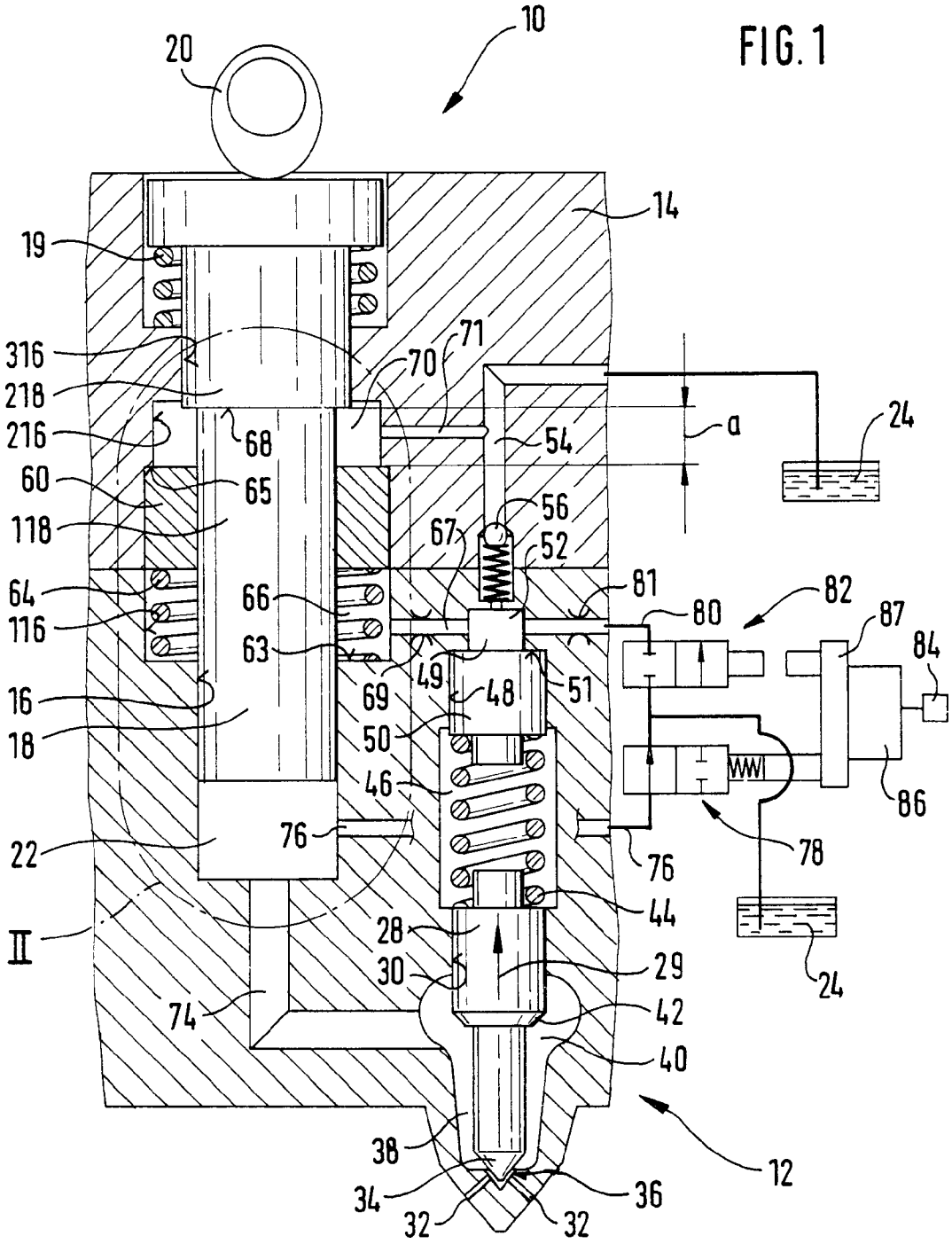
FIG. 1 shows a fuel injection system for an internal combustion engine in a simplified longitudinal section, with pump pistons in a first stroke position.
Figure 2:
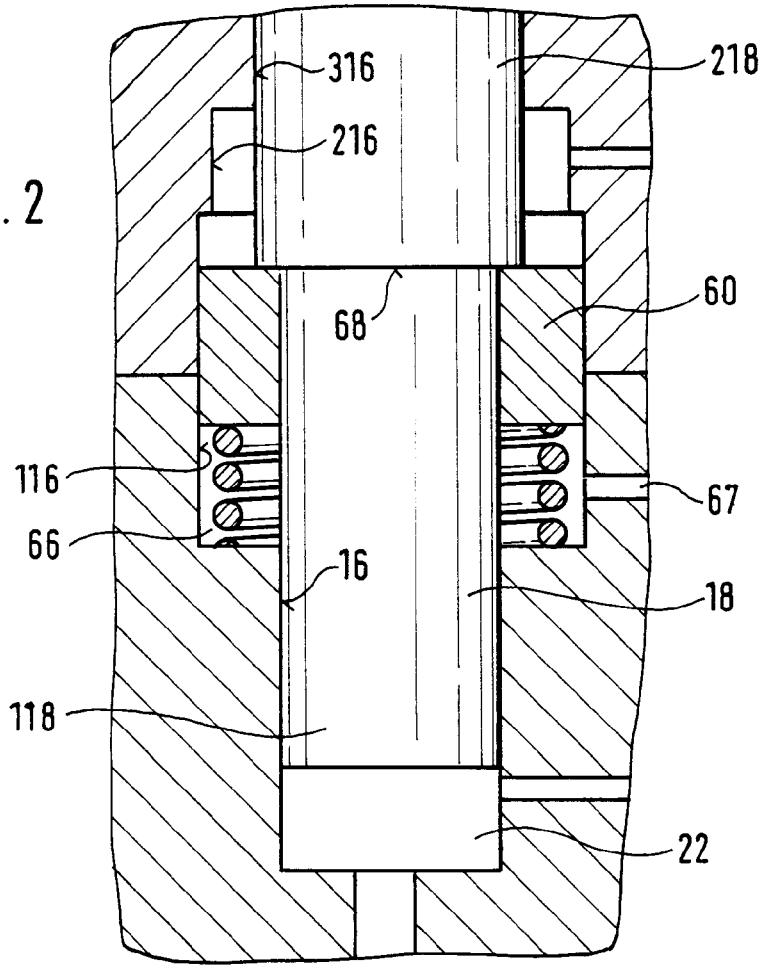
FIG. 2 shows a detail 11 of the fuel injection system with pump pistons in a second stroke position.

In FIGS. 1 and 2, a fuel injection system for an internal combustion engine of a motor vehicle is shown. The engine is preferably a self-igniting internal combustion engine. The fuel injection system is preferably embodied as a so-called unit fuel injector, and for each cylinder of the engine it has one high-pressure fuel pump 10 and one fuel injection valve 12, communicating with it, which together form a structural unit. Alternatively, the fuel injection system can be embodied as a so-called pump-line-nozzle system, in which the high-pressure fuel pump and the fuel injection valve of each cylinder are disposed separately from one another and communicate with one another via a line. The high-pressure fuel pump 10 has a pump body 14 with a cylindrical bore 16, in which a first pump piston 18 is guided tightly; this pump piston is driven in a reciprocating motion at least indirectly by a cam 20 of a camshaft of the engine, counter to the force of a restoring spring 19. In the cylindrical bore 16, the first pump piston 18 defines a pump work chamber 22, in which fuel at high pressure is compressed during the pumping stroke of the pump piston 18. Fuel is supplied to the pump work chamber 22 from a fuel tank 24 of the motor vehicle.

The fuel injection valve 12 has a valve body 26, which is joined to the pump body 14 and can be embodied in multiple parts, and in which an injection valve member 28 is guided longitudinally displaceably in a bore 30. The valve body 26, in its end region oriented toward the combustion chamber of the cylinder of the engine, has at least one and preferably a plurality of injection openings 32. The injection valve member 28, in its end region toward the combustion chamber, has a sealing face 34, which for instance is approximately conical, and which cooperates with a valve seat 36, embodied in the valve body 26 in its end region toward the combustion chamber; the injection openings 32 lead away from or downstream of this valve seat. In the valve body 26, between the injection valve member 28 and the bore 30, toward the valve seat 36, there is an annular chamber 38, which changes over, in its end region toward the valve seat 36, as a result of a radial enlargement of the bore 30 into a pressure chamber 40 surrounding the injection valve member 28. At the level of the pressure chamber 40, the injection valve member 28 has a pressure shoulder 42, which is the result of a reduction in the cross section. The end of the injection valve member 28 remote from the combustion chamber is engaged by a prestressed closing spring 44, by which the injection valve member 28 is pressed toward the valve seat 36. The closing spring 44 is disposed in a spring chamber 46 of the valve body 26, which chamber adjoins the bore 30.

Adjoining the spring chamber 46 on its end remote from the bore 30 in the valve body 26 is a further bore 48, in which a control piston 50 is guided tightly. In the bore 48, a control pressure chamber 52 is defined, on the side remote from the spring chamber 46, by the control piston 50 acting as a movable wall. The closing spring 44 is braced at least indirectly, for instance via a spring plate, on the control piston 50. Alternatively, it may be provided that the closing spring 44 is braced in stationary fashion in the spring chamber 46, while the control piston 50 is braced at least indirectly on the injection valve member 28, for instance via a piston rod protruding into the spring chamber 46. Remote from the spring chamber 46, the bore 48 has a portion 49 of lesser diameter, and the control piston 50 is pressed by the force of the closing spring 44 against an annular shoulder 51, formed at the transition from the bore 48 to its portion 49, whenever a slight pressure prevails in the control pressure chamber 52. The control pressure chamber 52 has a communication 54 with a low-pressure region, and the fuel tank 24 for example serves as this region. A check valve 56 that opens toward the control pressure chamber 52 is disposed in the communication 54.

The high-pressure fuel pump 10 has a second pump piston 60, which is embodied hollow-cylindrically, and through which the first pump piston 18 passes. In a portion 116 of the cylindrical bore 16 of enlarged diameter, compared to the region of the cylindrical bore 16 in which the first pump piston 18 is tightly guided, the region 116 being located remote from the pump work chamber, the second pump piston 60 is guided in the outer jacket thereof. The first pump piston 18 passes with slight play through the second pump piston 60 and is displaceable relative to the second pump piston 60. The portion 116 of the cylindrical bore 16 is adjoined, remote from the pump work chamber 22, by a portion 216 of the cylindrical bore 16 of further-reduced diameter. Between an annular shoulder 63, formed at the transition to the portion 116 of the cylindrical bore 16, and the second pump piston 60, a restoring spring 64 is fastened in place, by which the second pump piston 60 is pressed away from the pump work chamber 22, toward an annular shoulder 65 formed at the transition from portion 116 to portion 216 of the cylindrical bore 16. By means of the second pump piston 60, an annular work chamber 66 surrounding the first pump piston 18 is defined in the portion 116 of the cylindrical bore 16, toward the pump work chamber 22. The restoring spring 64 is disposed in the work chamber 66. The work chamber 66 has a communication 67 with the control pressure chamber 52.

The first pump piston 18 is embodied with a graduated diameter, and it has one region 118, passing through the second pump piston 60 and guided tightly in the cylindrical bore 16, of lesser diameter and one region 218, disposed toward the cam 20, of greater diameter. At the transition between the regions 118 and 218, an annular shoulder 68 oriented toward the second pump piston 60 is formed on the first pump piston 18. The end portion 316 of the cylindrical bore 16 oriented toward the cam 20 is enlarged in diameter in accordance with the diameter of the region 218 of the first pump piston 18, so that the first pump piston 18 is guided with its region 218 in the end portion 316 of the cylindrical bore 16. The chamber 70 defined between the first pump piston 18, with its annular shoulder 68, and the second pump piston 60 in the portion 216 of the cylindrical bore 16 has a communication 71 with a low-pressure region, and the fuel tank 24 can serve at least indirectly as this low-pressure region.

The first pump piston 18 is driven by the cam 20 in a reciprocating motion; beginning at an outer dead center position, in which the pump piston 18 protrudes the farthest out of the cylindrical bore 16, the pump piston is moved counter to the force of the restoring spring 19 as far as an inner dead center position, at which it plunges farthest into the cylindrical bore 16. In the outer dead center position of the first pump piston 18, shown in FIG. 1, this piston is disposed with its annular shoulder 68 at a spacing a from the second pump piston 60, so that via an initial stroke a, beginning at the outer dead center position, only the first pump piston 18 is moved. The second pump piston 60, because of the restoring spring 64, remains in contact with the annular shoulder 65 in the portion 116 of the cylindrical bore 16. When, after the initial stroke a, the first pump piston 18 with its annular shoulder 68 comes into contact with the second pump piston 60, then for the remaining stroke until the inner dead center position is reached, the second pump piston 60 is moved together with the first pump piston 18, as shown in FIG. 2. In its reciprocating motion, the second pump piston 60 compresses fuel in the work chamber 66.

From the pump work chamber 22, a conduit 74 leads through the pump body 14 and the valve body 26 to the pressure chamber 40 of the fuel injection valve 12. From the pump work chamber 22, or from the conduit 74, a communication 76 leads away to a relief chamber, which can at least indirectly be the fuel tank 24 or some other low-pressure region. The communication 76 is controlled by a first electrically actuated control valve 78. The control valve 78 can be embodied, as shown in FIG. 1, as a 2/2-way valve. The control pressure chamber 52 has a communication 54 with a relief chamber, and once again the fuel tank 24 or some other low-pressure region can serve as the relief chamber; this communication is controlled by a second electrically control valve 82, which may be embodied as a 2/2-way valve. A throttle restriction 69 is preferably provided in the communication 67 between the control pressure chamber 52 and the work chamber 66, and a throttle restriction 81 is preferably provided in the communication 80 between the control pressure chamber 52 and the relief chamber 24. By means of the throttle restrictions 69, 81, the inflow of fuel into the control pressure chamber 52 and the outflow of fuel from the control pressure chamber 52 can be established.

The control valves 78, 82 can have an electromagnetic actuator or a piezoelectric actuator and are triggered by an electronic control unit 84. The control valves 78, 82 can each have their own actuator, or they can share a common actuator 86, which via a bridge 87 actuates both control valves 78, 82, in each case counter to the force of a restoring spring. In a first stroke of the actuator 86, only the first control valve 78 is switched from an open to a closed position. In a further stroke of the actuator 86, the second control valve 82 is switched from a closed to an open position, while the first control valve 78 remains in its closed position. Between the bridge 87 and the first control valve 78, a spring can be provided, which is overcompressed in the course of the further stroke of the actuator 86. The first control valve 78 is preferably pressure-balanced.

The function of the fuel injection system will be described below. In the intake stroke of the pump piston 18 oriented outward from the cylindrical bore 16, fuel from the fuel tank 24 is delivered to the pump work chamber 22. The first control valve 78 is open at this time, so that fuel from the fuel tank 24 can reach the pump work chamber 22, and the second control valve 82 is closed, so that the control pressure chamber 52 is disconnected from the relief chamber 24. If the pressure in the control pressure chamber 52 is lower than in the low-pressure region 24, fuel flows into the control pressure chamber 52, with the check valve 56 open, and fills the control pressure chamber. Via the control pressure chamber 52, the work chamber 66 is also filled. The chamber 70 is filled via the communication 71 in the intake stroke of the pump piston 18. In the pumping stroke, oriented into the cylindrical bore 16, of the first pump piston 18, fuel from the chamber 70 is positively displaced into the low-pressure region 24, via the communication 71. As long as the first control valve 78 is open, high pressure cannot build up in the pump work chamber 22, and no fuel injection takes place. If a fuel injection is to be begin, the first control valve 78 is closed by the actuator 86, so that the pump work chamber 22 is disconnected from the relief chamber 24, and high pressure builds up in it. The second control valve 82 remains closed. Once the pressure in the pump work chamber 22 and thus in the pressure chamber 40 of the fuel injection valve 12 is high enough that its pressure force exerted on the injection valve member 28 via the pressure shoulder 42 is greater than the force of the closing spring 44, the injection valve member 28 moves in the opening direction 29 and opens the at least one injection opening 32. Once the first pump piston 18 has traversed the initial stroke a, then this piston also moves the second pump piston 60, and a pressure increase takes place in the work chamber 66 and in the control pressure chamber 52. Because of the pressure increase in the control pressure chamber 52, the control piston 50 is moved into the spring chamber, thus increasing the prestressing of the closing spring 44 and thus the closing force acting on the injection valve member 28. Afterward, the fuel injection valve 12 closes in response to the increased closing force on the injection valve member 28. Alternatively or in addition, it can be provided that to terminate the preinjection, the first control valve 78 is opened, so that the pump work chamber 22 and the pressure chamber 40 are relieved.

Figure 3:
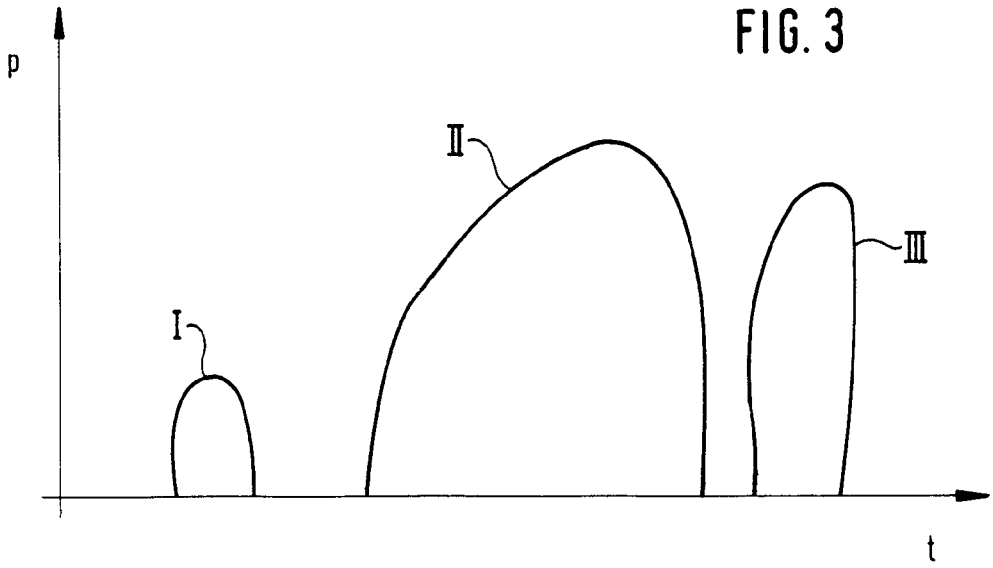
FIG. 3 shows the pressure course at injection openings of a fuel injection valve of the fuel injection system, during an injection cycle.

In FIG. 3, the course of the pressure p at the injection openings 32 of the fuel injection valve 12 is shown over the time t during one injection cycle. The first injection phase is equivalent to a preinjection, marked I in FIG. 3, of a small fuel quantity.

For a subsequent main injection, which corresponds to an injection phase 11 in FIG. 3, the second control valve 82 is opened by the control unit 84, because the actuator 86 brings about a further stroke. The first control valve 78 still remains closed, so that high pressure prevails in the pump work chamber 82. With the second control valve 82 opened, the control pressure chamber 52 is relieved, so that the control piston 50 moves back into its outer stroke position, in contact with the annular shoulder 51, and the prestressing of the closing spring 44 is reduced. As a result of the pressure prevailing in the pressure chamber 40, the injection valve member 28 then opens, and a fuel injection occurs. Fuel positively displaced from the work chamber 66 by the second pump piston 60 flows out into the relief chamber 24 via the opened second control valve 82.

To terminate the main injection, the control unit 84 puts the first control valve 82 into its closed switching position, because of the fact that the actuator 86 executes a shorter stroke. The control pressure chamber 52 is then disconnected from the relief chamber 24, and high pressure builds up in chamber 52 as in the work chamber 66, by which pressure the control piston 50 is displaced and the prestressing of the closing spring 44 is increased, so that the fuel injection valve closes. For a postinjection of fuel, corresponding to an injection phase marked III in FIG. 3, the second control valve 82 is opened again by the control unit 84, so that as a consequence of the relief of the control pressure chamber 52, the fuel injection valve 12 opens. To terminate the postinjection, the second control valve 82 is closed, and/or the first control valve 78 is opened.

The foregoing relates to a preferred exemplary embodiment of the invention, it being understood that other variants and embodiments thereof are possible within the spirit and scope of the invention, the latter being defined by the appended claims.

I claim:

1. A fuel injection system for an internal combustion engine, comprising a high-pressure fuel pump (10) and one fuel injection valve (12), communicating with the high pressure pump, for each cylinder of the engine, the high-pressure fuel pump (10) having a first pump piston (18), driven in a reciprocating motion by the engine, which piston defines a pump work chamber (22) to which fuel from a fuel tank (24) is supplied, the fuel injection valve (12) having a pressure chamber (40), communicating with the pump work chamber (22), and an injection valve member (28) by means of which at least one injection opening (32) is controlled, and this injection valve member, acted upon by the pressure prevailing in the pressure chamber (40), is movable counter to a closing force in an opening direction (29) in order to open the at least one injection opening (32), a first electrically actuated control valve (78), by which a communication (76) of the pump work chamber (22) with a relief chamber (24) is controlled, a second electrically actuated control valve (82), by which a communication (80) of a control pressure chamber (52) with a relief chamber (24) is controlled, wherein the control pressure chamber (52) is defined by a control piston (50), which acted upon by the pressure prevailing in the control pressure chamber (52) acts at least indirectly on the injection valve member (28) in a closing direction, the high-pressure fuel pump (10) having a second pump piston (60), with which the first pump piston (18) comes into contact after an initial pumping stroke (a), so that the second pump piston (60) likewise executes a pumping stroke, and a work chamber (66) defined by the second pump piston (60) and communicating with the control pressure chamber (52).

2. The fuel injection system according to claim 1, wherein the second pump piston (60) is embodied hollow-cylindrically, and wherein the first pump piston (18) passes through the second pump piston (60).

3. The fuel injection system according to claim 2, wherein the first pump piston (18) is embodied with a graduated diameter defining an annular shoulder (68) formed at the diameter transition, which shoulder (68) comes to rest on the second pump piston (60) after the initial pumping stroke (a).

4. The fuel injection system according to claim 1, wherein the closing force on the injection valve member (28) is generated by a closing spring (44) which is braced at least indirectly on the control piston (50).

5. The fuel injection system according to claim 2, wherein the closing force on the injection valve member (28) is generated by a closing spring (44) which is braced at least indirectly on the control piston (50).

6. The fuel injection system according to claim 3, wherein the closing force on the injection valve member (28) is generated by a closing spring (44) which is braced at least indirectly on the control piston (50).

7. The fuel injection system according to claim 1, wherein the two control valves (78, 82) are actuated by a common actuator (86).

8. The fuel injection system according to claim 2, wherein the two control valves (78, 82) are actuated by a common actuator (86).

9. The fuel injection system according to claim 3, wherein the two control valves (78, 82) are actuated by a common actuator (86).

10. The fuel injection system according to claim 4, wherein the two control valves (78, 82) are actuated by a common actuator (86).

11. The fuel injection system according to claim 5, wherein the two control valves (78, 82) are actuated by a common actuator (86).

12. The fuel injection system according to claim 6, wherein the two control valves (78, 82) are actuated by a common actuator (86).

13. The fuel injection system according to claim 1, wherein in the pumping stroke of the two pump pistons (18, 60) for a fuel injection when the first control valve (78) is closed, the second control valve (82) is opened, so that the control pressure chamber (52) is relieved, and that for an interruption or termination of the fuel injection, the second control valve (82) is closed while the first control valve (78) is closed, so that in the control pressure chamber (52), because of its communication with the work chamber (66), high pressure prevails, which via the control piston (50) closes the fuel injection valve (12).

14. The fuel injection system according to claim 2, wherein in the pumping stroke of the two pump pistons (18, 60) for a fuel injection when the first control valve (78) is closed, the second control valve (82) is opened, so that the control pressure chamber (52) is relieved, and that for an interruption or termination of the fuel injection, the second control valve (82) is closed while the first control valve (78) is closed, so that in the control pressure chamber (52), because of its communication with the work chamber (66), high pressure prevails, which via the control piston (50) closes the fuel injection valve (12).

15. The fuel injection system according to claim 3, wherein in the pumping stroke of the two pump pistons (18, 60) for a fuel injection when the first control valve (78) is closed, the second control valve (82) is opened, so that the control pressure chamber (52) is relieved, and that for an interruption or termination of the fuel injection, the second control valve (82) is closed while the first control valve (78) is closed, so that in the control pressure chamber (52), because of its communication with the work chamber (66), high pressure prevails, which via the control piston (50) closes the fuel injection valve (12).

16. The fuel injection system according to claim 4, wherein in the pumping stroke of the two pump pistons (18, 60) for a fuel injection when the first control valve (78) is closed, the second control valve (82) is opened, so that the control pressure chamber (52) is relieved, and that for an interruption or termination of the fuel injection, the second control valve (82) is closed while the first control valve (78) is closed, so that in the control pressure chamber (52), because of its communication with the work chamber (66), high pressure prevails, which via the control piston (50) closes the fuel injection valve (12).

17. The fuel injection system according to claim 7, wherein in the pumping stroke of the two pump pistons (18, 60) for a fuel injection when the first control valve (78) is closed, the second control valve (82) is opened, so that the control pressure chamber (52) is relieved, and that for an interruption or termination of the fuel injection, the second control valve (82) is closed while the first control valve (78) is closed, so that in the control pressure chamber (52), because of its communication with the work chamber (66), high pressure prevails, which via the control piston (50) closes the fuel injection valve (12).

* * * * *